US007223040B2

(12) United States Patent
Koike et al.

(10) Patent No.: US 7,223,040 B2
(45) Date of Patent: May 29, 2007

(54) BINDER

(75) Inventors: Seiichi Koike, Osaka (JP); Tomoya Ogawa, Osaka (JP)

(73) Assignees: Kokuyo Co., Ltd., Osaka (JP); Kabushikikaisha Izumiseisakusho, Aichi (JP)

( * ) Notice: Subject to any disclaimer, the term of this patent is extended or adjusted under 35 U.S.C. 154(b) by 340 days.

(21) Appl. No.: 10/326,968

(22) Filed: Dec. 24, 2002

(65) Prior Publication Data

US 2003/0123923 A1 Jul. 3, 2003

(30) Foreign Application Priority Data

Dec. 27, 2001 (JP) ..... 2001-397572
Aug. 30, 2002 (JP) ..... 2002-254580

(51) Int. Cl.
*B42F 3/04* (2006.01)
*B42F 13/20* (2006.01)

(52) U.S. Cl. ..... 402/38; 402/26; 402/31; 402/39; 402/70; 402/73

(58) Field of Classification Search ..... 402/26, 402/31, 37, 38, 39, 41, 70, 73, 80 R, 500, 402/502; D19/26, 27
See application file for complete search history.

(56) References Cited

U.S. PATENT DOCUMENTS 1,813,599 A * 7/1931 Adams ..... 402/37
2,013,552 A * 9/1935 Dawson ..... 402/38
2,198,512 A 4/1940 Handler
2,381,040 A * 8/1945 Dawson et al. ..... 402/39
2,715,906 A * 8/1955 Lucchesi ..... 402/20
4,172,675 A * 10/1979 Lacourt ..... 402/27
4,624,595 A * 11/1986 Ohminato ..... 402/34
4,690,580 A * 9/1987 Kissel ..... 402/39
4,815,882 A * 3/1989 Ohminato ..... 402/34
5,028,159 A * 7/1991 Amrich et al. ..... 402/20
5,286,128 A * 2/1994 Gillum ..... 402/39
5,511,825 A * 4/1996 Van De Pol ..... 281/36
5,618,122 A * 4/1997 Constantine ..... 402/22
5,692,847 A * 12/1997 Zane et al. ..... 402/38
5,692,848 A * 12/1997 Wada ..... 402/39

(Continued)

FOREIGN PATENT DOCUMENTS

JP 60-72278 5/1985

(Continued)

*Primary Examiner*—Monica Carter
*Assistant Examiner*—Eric A. Gates
(74) *Attorney, Agent, or Firm*—Lowe Hauptman & Berner

(57) ABSTRACT

Two first binding members supported rotatably by a base, which will be fixed to a back cover, and two second binding members, which engage with the front ends of the first binding members to form closed loops, are provided. Spaces between the base sections of the first and second binding members are connected via a first and second connecting plate, respectively. A releasing element is disposed between the respective connecting members, and a force is given by the releasing element in the direction that the closed loops via binding members are released. It is such adapted that, when the first binding members are nipped by fingertips and given an operation force in the direction that the same come closer to each other, the engagement with the second members are released and the front ends can rotate in the direction that the same are opened.

20 Claims, 17 Drawing Sheets

U.S. PATENT DOCUMENTS 5,782,569 A * 7/1998 Mullin et al. ..... 402/36
5,975,784 A * 11/1999 Whaley ..... 402/34
6,036,394 A * 3/2000 Cheng ..... 402/26
6,045,286 A * 4/2000 Tung ..... 402/37
6,203,229 B1 * 3/2001 Coerver ..... 402/38
6,270,280 B1 * 8/2001 Baumann ..... 402/39
6,276,862 B1 8/2001 Snyder et al.
6,328,497 B1 * 12/2001 To ..... 402/26

FOREIGN PATENT DOCUMENTS

JP 62-114779 7/1987
JP 1-108788 7/1989
JP 1-178988 12/1989

* cited by examiner

BINDER

BACKGROUND OF THE INVENTION

1. Field of the Invention

The present invention relates to a binder, and in particular, to a binder in which first and second binding members for forming closed loops can be rotated in the open/close direction, and the closed loop can be released with a slight operating force.

2. Description of the Related Art

Conventionally, a binder used for a ring file or the like comprises a base fixed to a back cover or to a position adjacent thereto of the file or the like, a pair of first binding members disposed at two positions in the longitudinal direction on the base, and a pair of second binding members positioned at the opposite sides to these first binding members and are brought into contact with the respective front ends of the first binding members. The first and second binding members are connected respectively at the base side thereof by first and second connecting plates; thereby the first binding members and second binding members are adapted to be capable of rotating in the open/close direction respectively.

However, in the known binder as described above, such an arrangement is adopted that, when the binding members are in the closed state where closed loops are formed, the first and second connecting plates act to prop the respective binding members so as to maintain the closed state thereof. Due to this, when opening the binding members, since it is necessary to give a strong external force to the binding members to forcibly open the front ends between the first and second binding members, there resides in such an inconvenience that operation thereof is difficult for a user who is poor in operating force.

On the other hand, when the binding members are operated from the open state to the closed state, such an inconvenience that the binding members are closed snapping a large sound is created since the spring force accompanying the angle change of the connecting plates act strongly to maintain the opened state when the binding members are rotated in the close direction exceeding a specific angle, and it causes not only to emit an annoying noise but also to render such a fear that a finger might be pinched during closing operation to the user.

SUMMARY OF THE INVENTION

The present invention has been proposed in view of the problems, and an object of the invention is to provide a binder capable of opening/closing binding members without requiring a large operating force, and does not emit a noise or render a fear upon closing operation of the binder.

To achieve the object, the invention adopts such an arrangement that a binder comprises first binding members supported rotatably by a base to be mounted on a cover body and second binding members supported rotatably by the base for forming closed loops by engaging with the respective front ends of the first binding members:

the binder further comprises a first connecting member for connecting the first binding members to each other within the base, a second connecting member for connecting the second binding members to each other within the base, and a releasing means disposed within an area of the respective connecting members to provide a force in a direction that the closed loops are released; and Wherein, by providing the force to the first binding members or the second binding members in the direction that crosses the axial direction thereof, the engagement is released so that the first and second binding members are opened. With this arrangement, an operating force is provided to the first binding members or the second binding members in the direction that crosses the axial direction thereof to release the engagement between the first and second binding members, the binding members are made to rotate in the direction that the same are opened-by the releasing means. Accordingly, it is possible to open the binding members in a state that the operating force is reduced. On the other hand, when operating to make the binding members into the closed state, since the operation is made in the direction opposite to the direction of the force of the releasing means, a noise is not emitted and a fear can be also eliminated, different from the conventional binder, by preventing the binder from closing strongly when the binding members shift into the closed state to form closed loops.

Also, the invention may adopt such an arrangement that a binder comprises a pair of first binding members supported rotatably by a base to be mounted to a cover body and a pair of second binding members supported rotatably by the base for forming closed loops by engaging with the respective front ends of the first binding members:

the binder further comprises a first connecting member for connecting the first binding members to each other within the base, a second connecting member for connecting the second binding members to each other within the base, and a releasing means disposed so as to cross the respective connecting members to provide a force in a direction that the closed loops are released; and Wherein, by providing the force that makes the first binding members or the second binding members closer to each other, the engagement is released so that the first and second binding members are opened. With this arrangement, the engagement can be released by nipping the first binding members or the second binding members with fingertips to make the same closer to each other, and the binding members is made rotatable in the open direction by the releasing means.

In the invention, it is preferred to adopt such an arrangement that the first and second connecting members extend along the base; the inner sides in the smaller width direction of the respective connecting members are positioned lower than the outer sides thereof when the first and second binding members are in the closed position; the inner sides of the respective connecting members are shifted to a position higher than the outer sides thereof by the releasing means so that the first and second binding members are opened when the engagement between the first and second binding members is released. With this arrangement, the force of the releasing means and the position of the connecting members interact with each other, and it becomes possible to maintain the closed position and the opened position of the first and second binding members selectively. Accordingly, the first and second binding members in the opened state are prevented from swinging.

The releasing means is comprised by a coil spring, and the coil spring is supported by a spring receiving portion formed between the first and second connecting members so as not to drop off. With this arrangement, assembly of the coil spring can be carried out easily, and it is possible to prevent operation failure due to repeated and continuous use from occurring since continuous maintenance of the coil spring at a specific position.

It is preferred to adopt such an arrangement that the releasing means is comprised by a leaf spring extending between the first and second connecting members being supported thereby not to drop off. With this arrangement, the leaf spring is maintained at a specific position and it is possible to prevent effectively operation failure from occurring.

It is possible that the releasing means is comprised by a wire member, and the wire member is formed of a first portion of the wire member disposed so as to cross the first and second connecting members, and a second portion of the wire member that continues to the first portion of the wire member and the the axis direction thereof is shifted by a predetermined angle with respect to the first portion of the wire member. With this arrangement, it is possible to apply the releasing means to obtain a spring force only by adjusting the axial direction of the wire member. Also, since the wire member can be assembled easily, it is possible to lead to a better productivity of the binder.

Further, it is preferred to adopt such an arrangement that the second wire member is formed into a configuration or a size to be generally received within the area of the first connecting member or the second connecting member.

Furthermore, such an arrangement is preferably adopted that the wire member is formed along the longitudinal direction of the base into a generally symmetrical configuration with respect to a virtual straight line along the width direction of the base. Owing to this, even if the wire member is used as a releasing means, a force is generated in a state preferably dispersed in the releasing direction of the closed loop, and it is possible to prevent opening failure or the like from occurring.

Still furthermore, such an arrangement that the wire member is supported by the base via an anti-drop-off mechanism is adopted. In the arrangement, since there is no possibility that the wire member is shifted unintentionally, it is possible to allow the spring force to act in a stable state.

It is preferred to adapt so that the first and second connecting members are, or the first binding members or the second binding members are bent and deformed to release the engagement when a force is given in the direction that the engagement between the first and second binding members is released. Owing to this, since a large operating force is not required for releasing the engagement, it is possible to provide a binder excellent in operation performance. Particularly, when such a structure that the first and second connecting members are bent and deformed is adopted, it is possible to provide a binder excellent in durability since the binding member may be made of a material having rigidity.

Further, it is possible to adopt such an arrangement that the first and second connecting members comprises first and second connecting plates extending along the base, and the outer edges of the ends along the longitudinal direction of the respective connecting plates are formed into inclined edges where the width becomes narrower. Owing to the arrangement, since the end areas in the longitudinal direction of the respective connecting plates become to be bent easily, it becomes possible to reduce the force for releasing the engagement between the first and second binding members.

DETAILED DESCRIPTION OF THE PREFERRED EMBODIMENT

Preferred embodiments of the invention will be described below with reference to the drawings.

[First Embodiment]

Figure 1:
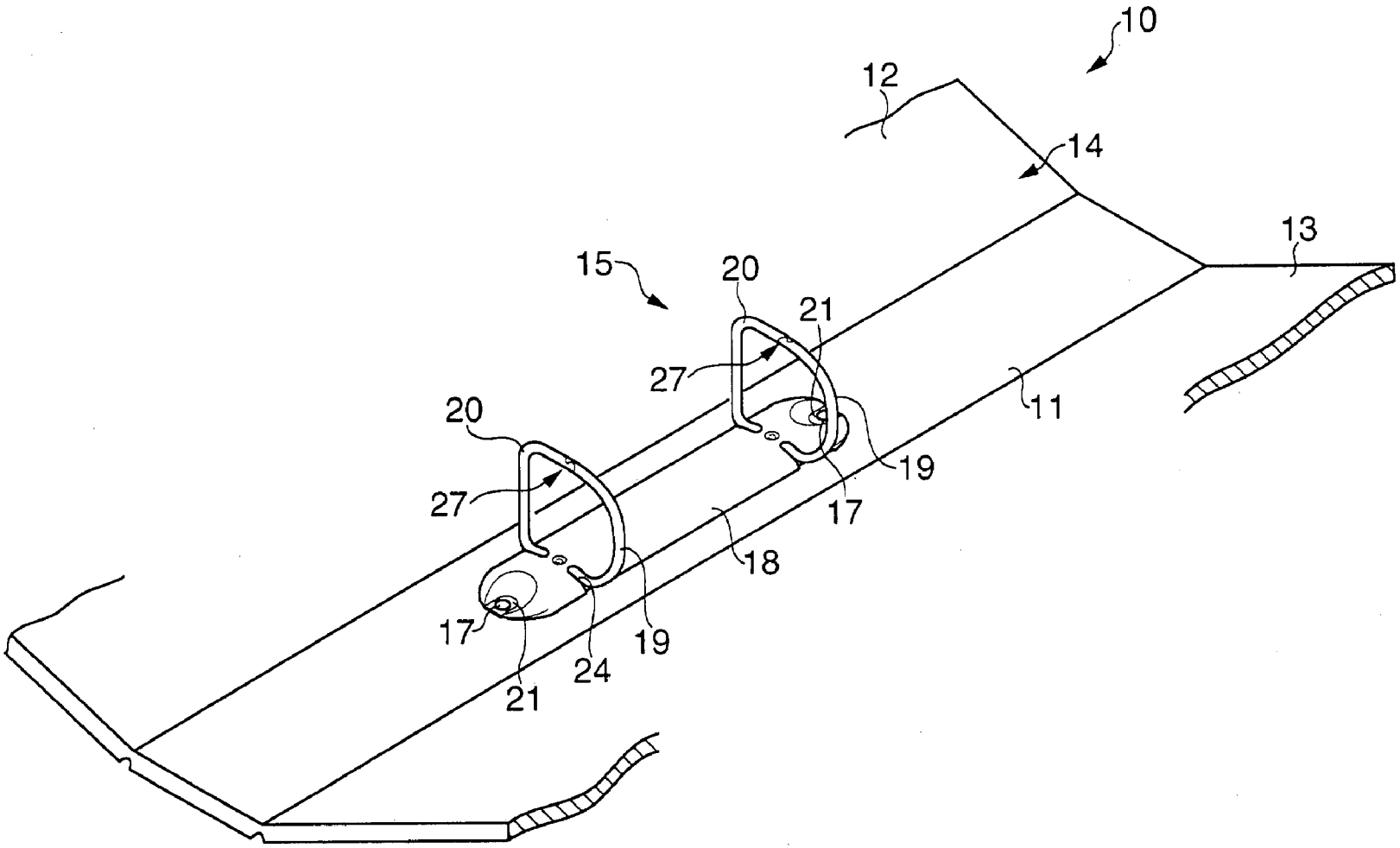
FIG. 1 is a schematic perspective view of principal parts of a binder according to a first embodiment, which is applied to a file.
Figure 2:
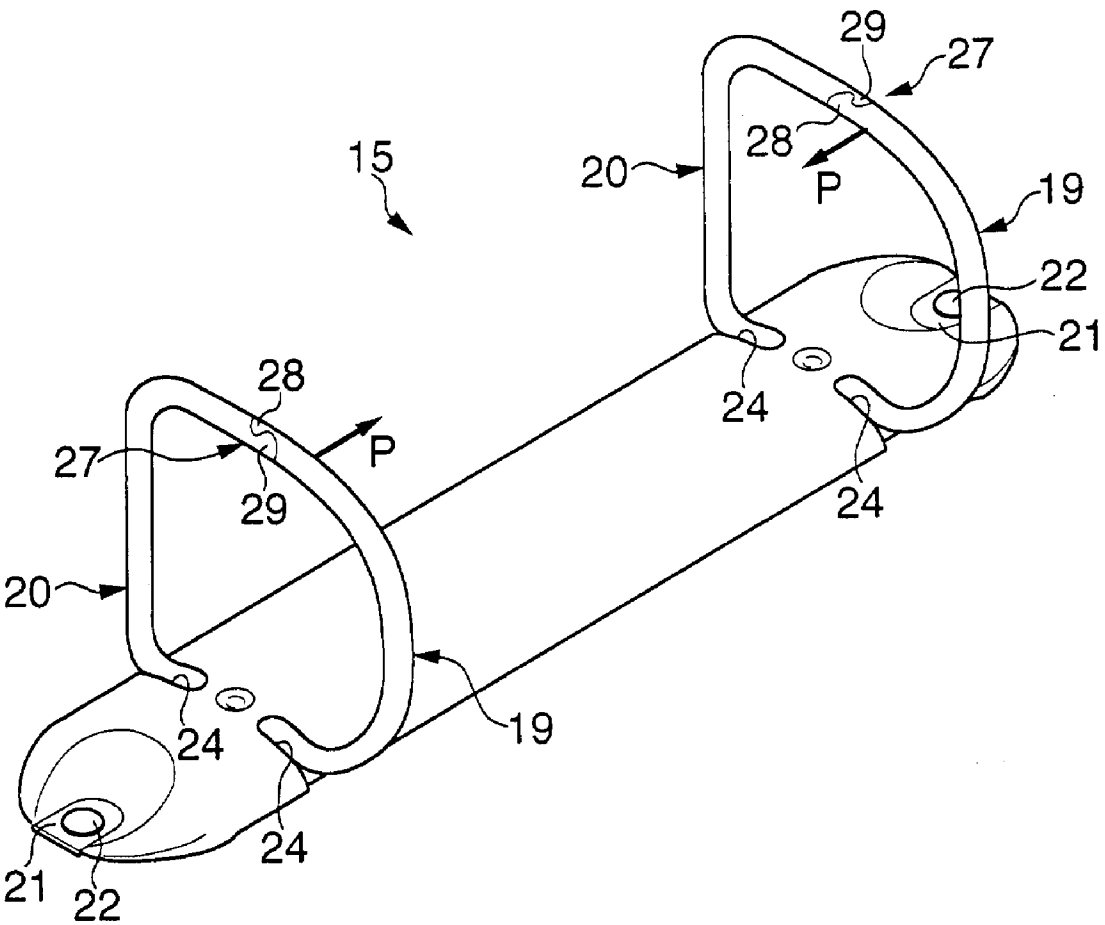
FIG. 2 is an enlarged schematic perspective view of the binder.
Figure 3:
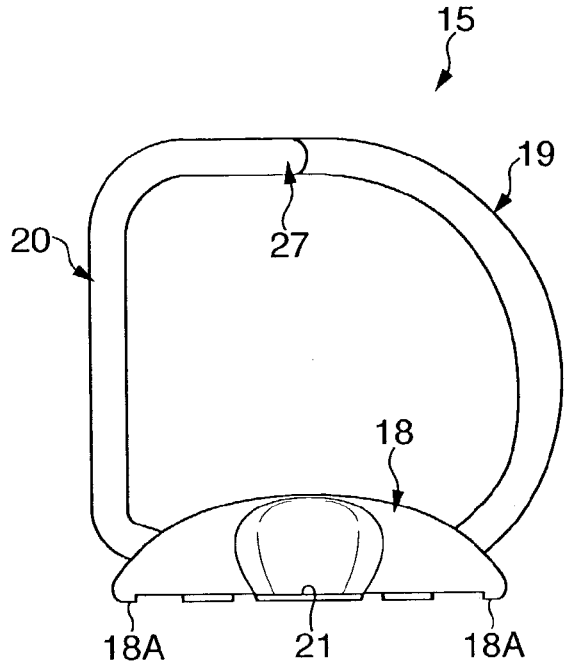
FIG. 3 is a front view of FIG. 2.
Figure 4:
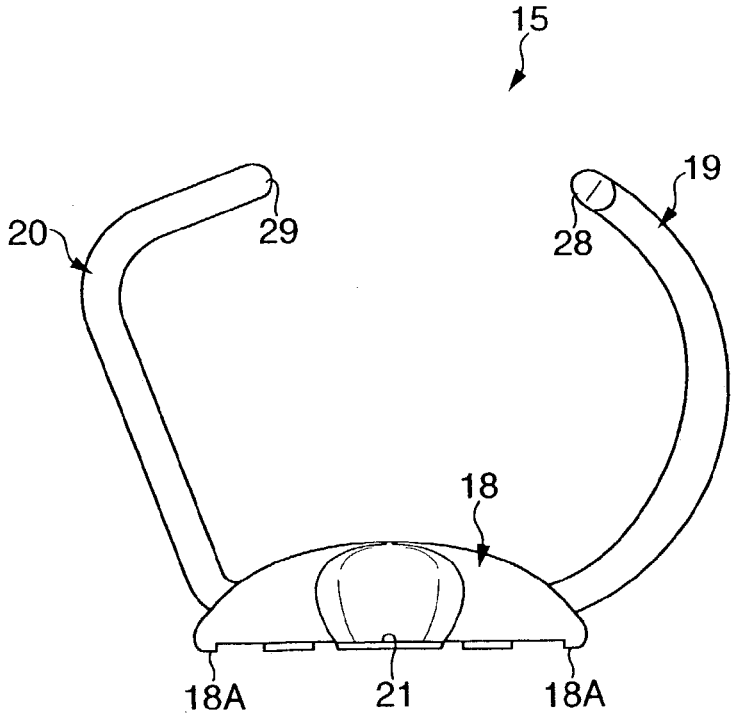
FIG. 4 is a front view of the binder in the opened state.
Figure 5:
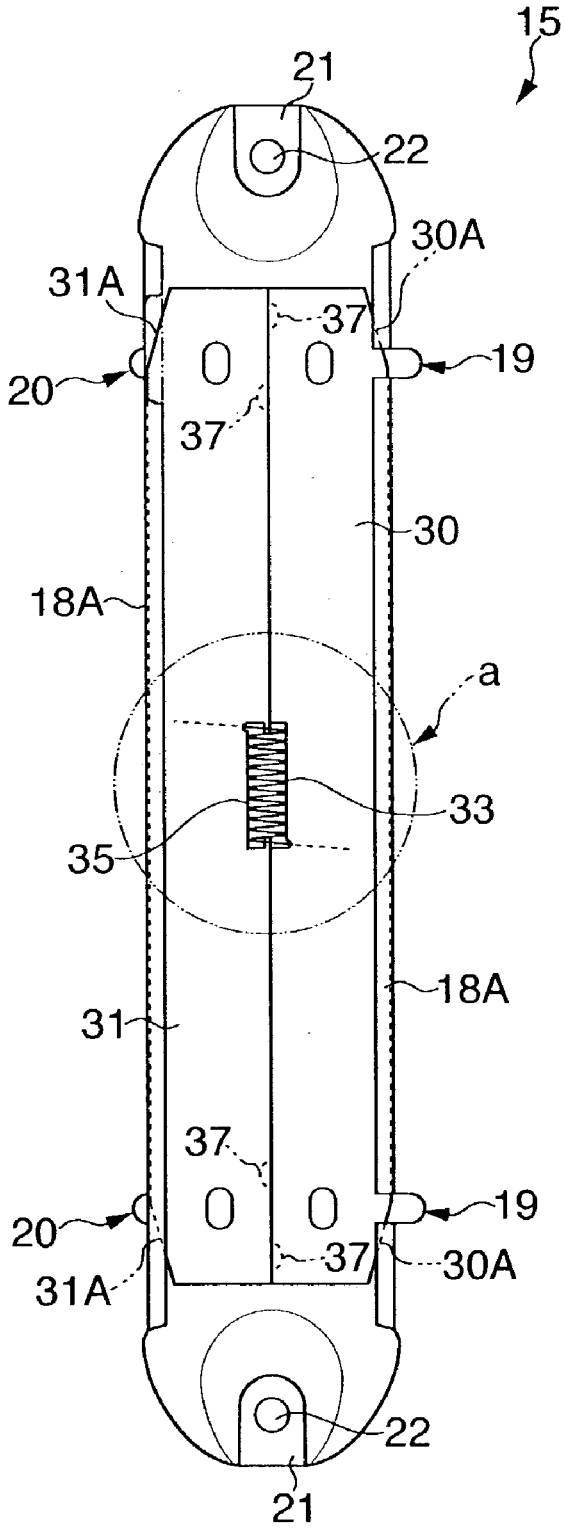
FIG. 5 is a bottom view of the binder.

FIG. 1 shows a schematic perspective view of principal parts of a binder according to a first embodiment applied to a file; FIG. 2 shows an enlarged perspective view of the binder. In these drawings, a file 10 comprises a cover body 14 provided with a front cover 12 and a rear cover 13 continued thereto through a back cover 11 therebetween and a binder 15 mounted on the inside face of the back cover 11.

The binder 15 comprises a base 18 extending in the upper and lower (longitudinal) direction of the back cover 11 and being mounted on the inner face of the back cover 11 by rivets 17, 17, a pair of first binding members 19, 19 supported by the end portions at the rear cover 13 side of the base 18 respectively, and a pair of second binding members 20, 20 supported by the end portions at the front cover 12 side of the base 18 respectively to form a closed loop being engaged with the respective front ends of the first binding members 19, 19 together with the base 18. Here, respective members constituting the binder 15 are formed of a metallic material such as stainless or the like.

Figure 8:
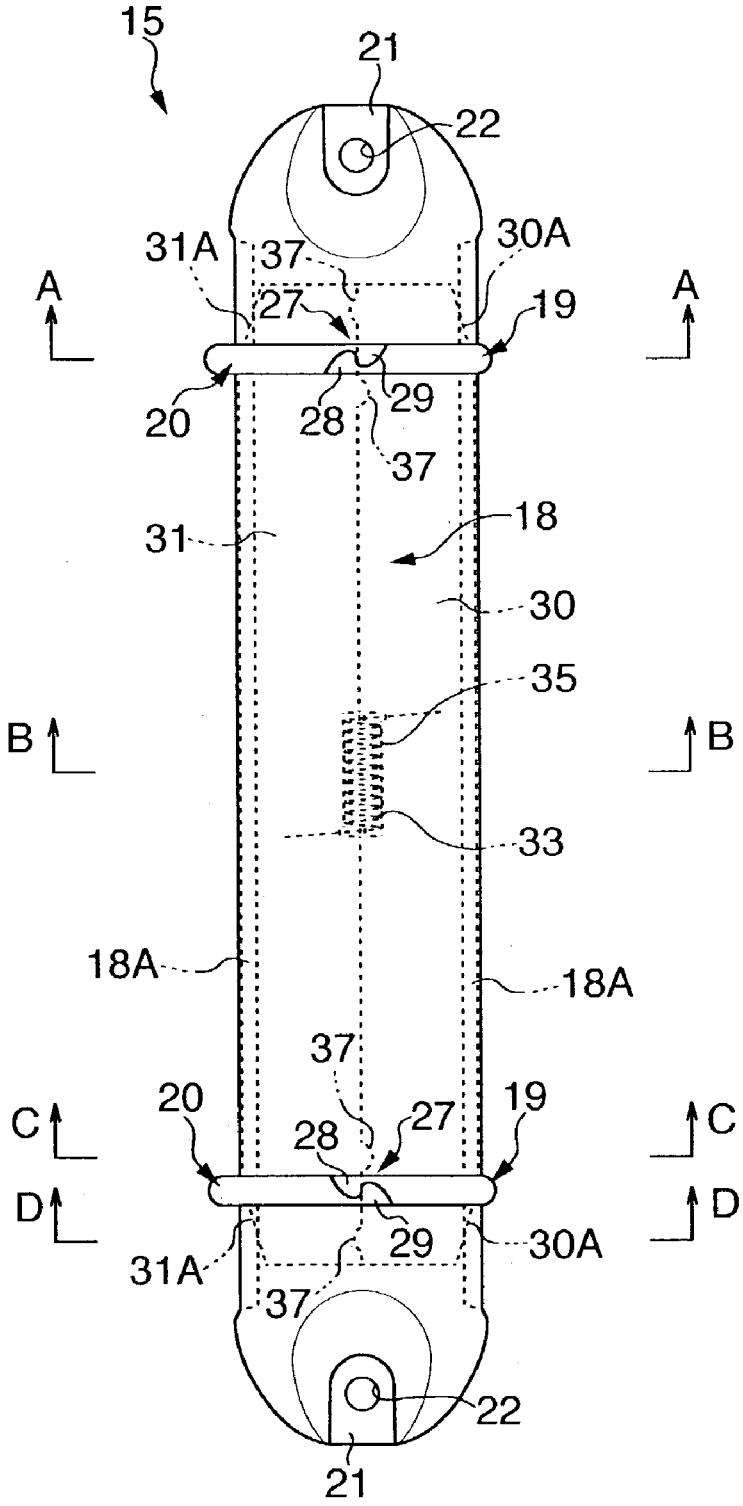
FIG. 8 is a plan view of the binder.
Figure 9:
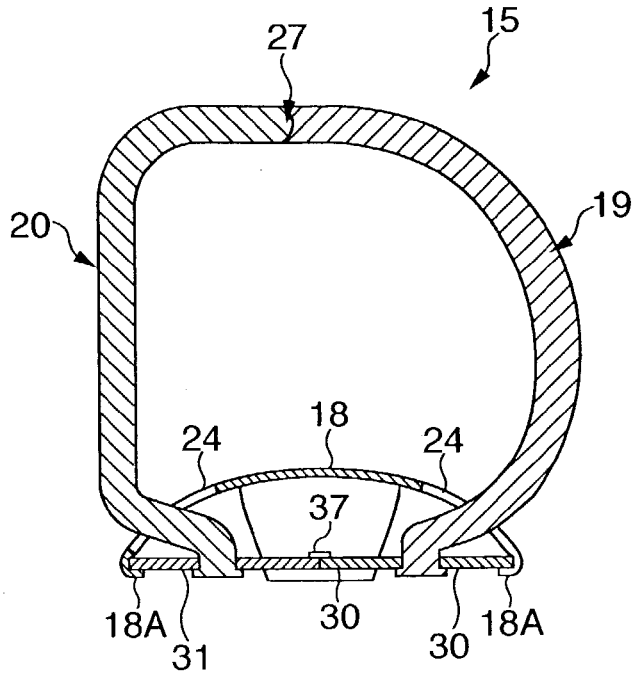
FIG. 9 is an enlarged sectional view taken along an arrow line A—A of FIG. 8.
Figure 10:
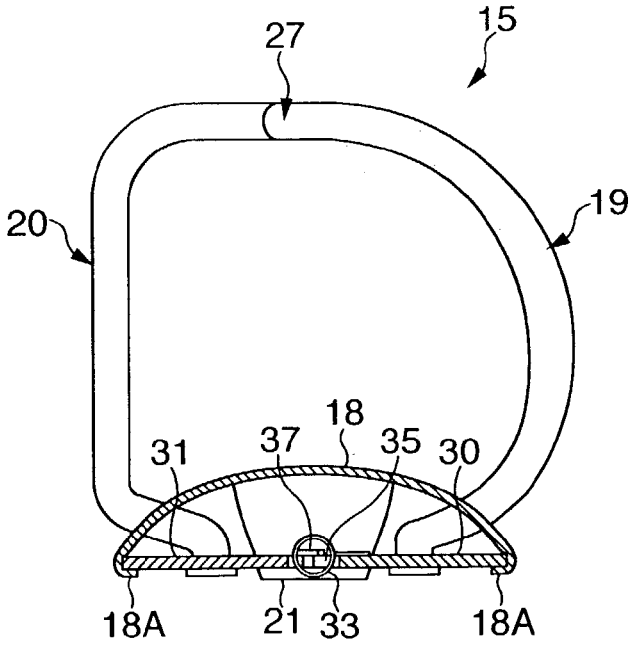
FIG. 10 is an enlarged sectional view taken along an arrow line B—B of FIG. 8.
Figure 11:
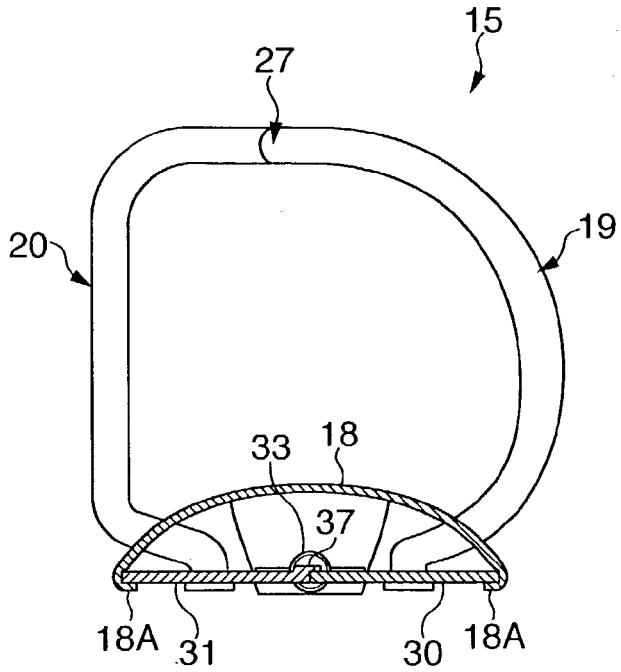
FIG. 11 is an enlarged sectional view taken along an arrow line C—C of FIG. 8.
Figure 12:
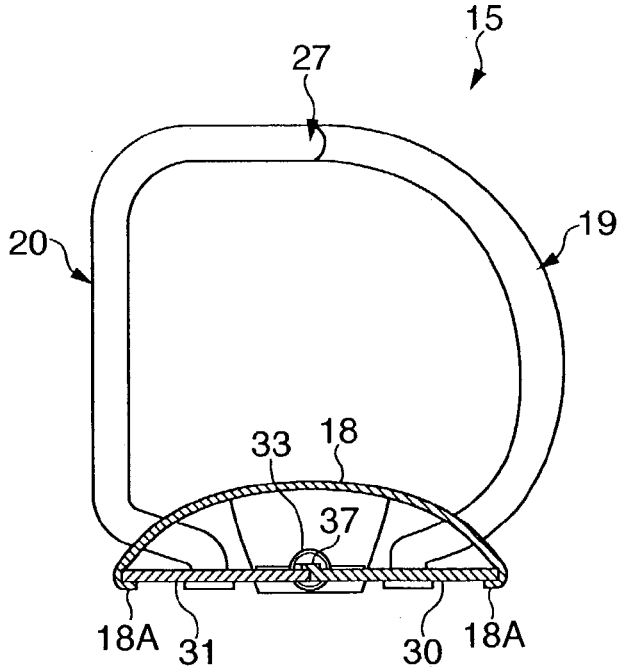
FIG. 12 is an enlarged sectional view taken along an arrow line D—D of FIG. 8.

As shown in FIGS. 3–12, the base 18 is formed into a curvature in configuration having a maximum height at the center thereof and being opened at the bottom thereof. Both end sides in the longitudinal direction of the base 18 are respectively pressed to have step so as to form mounting face portions 21, 21 for being mounted to the back cover 11, and generally at the central area within the face of the respective mounting face portions 21, 21, rivet holes 22, 22 are formed respectively (refer to FIGS. 5 and 8). Also, at two locations in the longitudinal direction of the base 18, four slots 24 for allowing the base sides of the first and second binding members 19, 20 to pass through are formed at both sides along the smaller width direction. As shown in FIG. 9, each slot 24 is formed from a point near the central area in the smaller width direction of the base 18 to the side end thereof; thereby, a large rotational angles of the first and second binding members 19, 20 are ensured respectively.

The first binding members 19 are formed into a generally semi-arc configuration viewed from the front thereof; while the second binding members 20 are formed into a generally U-letter type viewed from the front thereof; and are such adapted that a closed state is maintained by forming a closed loop via engagement portions 27 formed at the front ends of the respective binding members 19, 20, and that the front ends of the respective binding members 19, 20 can be opened by releasing the engagement. As shown in FIG. 8, the engagement portion 27 includes an outwardly hook-shaped portion 28 formed at the front end of the first binding members 19 and an inwardly hook-shaped portion 29 formed at the front end of the second binding members 20 and is capable of engagement with the outwardly hook-shaped portion 28. The engagement portions 27 are such adapted that, when an operation force directed in the direction of the arrows-P in FIG. 2 is applied to make the front ends of the first binding members 19, 19 closer to each other, the first binding members 19, 19 can be inclined in a direction that the both thereof become closer to each other in a state that the front ends of the first binding members 19, 19 do not interfere with the second binding members 20, 20 and the first binding members 19, 19 generally maintain their own configuration.

In the internal space of the base 18, a first connecting plate 30 as a connecting member, which is a thin and long rectangular plate in configuration, is disposed along the longitudinal direction of the base 18 between the respective base sections of the first binding members 19, 19; and also, a second connecting plate 31 as a connecting member of the generally same configuration is disposed along the longitudinal direction of the base 18 between the second binding members 20, 20; thereby it is adapted so that the first binding members 19 and the second binding members 20 forming units respectively can be rotated simultaneously. These first and second connecting plates 30, 31 are fixed by caulking the base sections of the first and the second binding members 19, 20 being passed through them. Further, the outer sides in the smaller width direction of the first and the second connecting plates 30, 31 are supported by the caulking portions 18A formed at both ends in the smaller width direction of the base 18 so as not to drop off.

Figure 6:
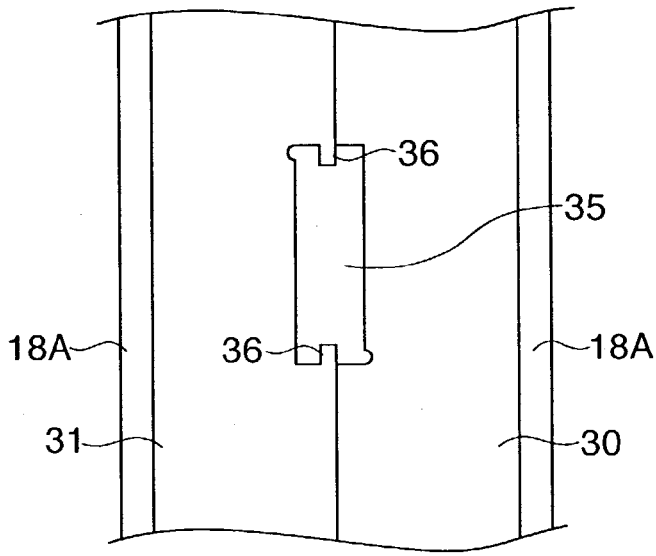
FIG. 6 is an enlarged view of the part-a in FIG. 5, in which a coil spring is omitted.
Figure 7:
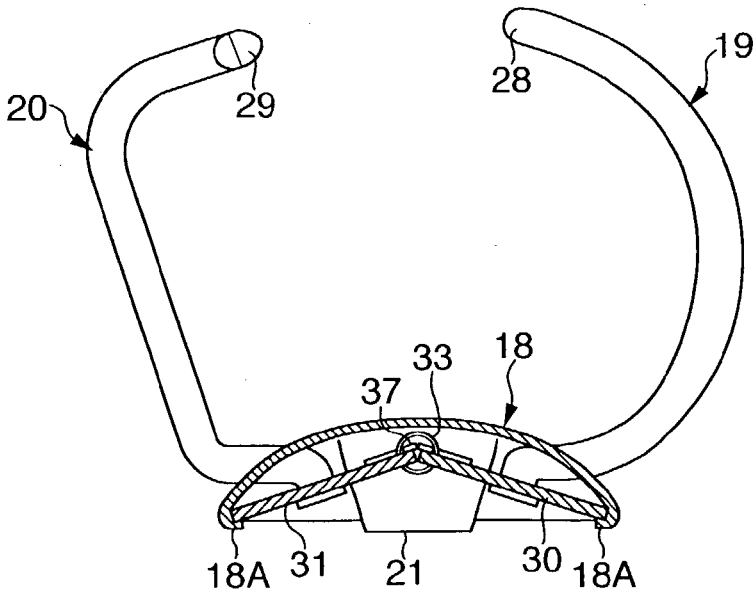
FIG. 7 is a sectional view of the binder in the opened state.

The inner ends of the first and second connecting plates 30, 31, which come to the inner side in the smaller width direction thereof, are adapted to be generally brought into contact with each other; and in the central area of the contact edge portion, a notch 35 as a spring receiving section, which supports a coil spring 33 to be incapable of dropping off as a releasing means, is formed. As shown in FIG. 6 being enlarged, the notch 35 has a configuration which is provided with protruding pieces 36 protruding toward the inside of the notch 35 and is adapted to support the coil spring 33 not to drop off in such manner that the protruding pieces 36 are located within the respective edges of the coil spring 33. Further, on the contact edge portions of the first and second connecting plates 30, 31, a plurality of small protruding pieces 37 pressed to have steps so as to position slightly upper with respect to the position of the faces of the connecting plates 30, 31 are formed, and are adapted to be coupled so that these small protruding pieces 37 ride on the mating contact edge portion to regulate the position of the faces of the first and second connecting plates 30, 31. Furthermore, the first and second connecting plates 30, 31 are such formed that the outer edges of the end portions in the longitudinal direction become gradually narrower in the narrower width direction thereof; i.e., into inclined edges 30A, 31A. Owing to this, the end side areas in the longitudinal direction of the respective connecting plates 30, 31 can be bent easily. In addition, the first and second connecting plates 30, 31 can be such mounted that, when the first and second binding members 19, 20 are closed, the inner sides in the smaller width direction are positioned slightly lower than the outer sides; while when the first and second binding members 19, 20 are opened, the inner sides are positioned higher than the outer sides to deform into a generally L shape.

The coil spring 33 is such disposed that one end side thereof rides on the first connecting plate 30, while the other end side thereof rides on the second connecting plate 31. The coil spring 33 is adapted to, ordinarily, provide a force in the direction that the first and second binding members 19, 20 are opened; i.e., in the direction that the closed loop is released. In this case, the spring force of the coil spring 33 is adapted to be smaller than the engagement force in the engagement portion 27. Owing to this, unless the operating force is given to the first binding members 19, 19, the closed loop by the first and second binding members 19, 20; i.e., the closed state is maintained to prevent unintentional opening thereof from occurring.

In the arrangement, when disengaging to open a closed state in which the first and second binding members 19, 20 form the closed loop together with the base 18, the engagement portions 27, 27 can be disengaged by, for example, positioning the thumb and the forefinger on the respective front ends of the first binding members 19, 19 so as to stride them, and applying an operation force in the direction that both fingers come closer to each other (the direction indicated by the arrows P, P in FIG. 2). Owing to this, the spring force of the coil spring 33 acts on the first and second connecting plates 30, 31 to make an angle change so that the inner sides thereof shift upward (refer to FIG. 7); resulting in opening the front ends of the respective binding members 19, 20 supported by the connecting plates 30, 31. Here, it is adapted that, when the operating force is given to the first binding members 19, 19, the first connecting plate 30 in the base area of the first members 19, 19 is bent and deformed, and at the same time, slightly inclined so that the front end side of the first binding members 19, 19 come closer to each other. Owing to this, the first binding members 19, 19 is allowed to make an angle change to release the engagement while maintaining generally the configuration of them.

On the other hand, when restoring the closed state by forming the closed loop by the first and second binding members 19, 20, the front ends of the first and second binding members 19, 20 are rotated against the spring force of the coil spring 33 in the direction that the front ends comes closer to each other. Owing to this, the outwardly hook-shaped portion 28 and the inwardly hook-shaped portion 29 of the respective engagement portions 27, 27 slide and engaged with each other to form the closed loop.

Thus, according to the first embodiment, it makes possible to release the closed state between the first binding members 19 and the second binding members 20 only by giving a slight operation force to the first binding members 19; while when restoring the same to the closed state, it makes possible to perform a smooth engagement preventing a possibility of emitting a noise.

Figure 13:
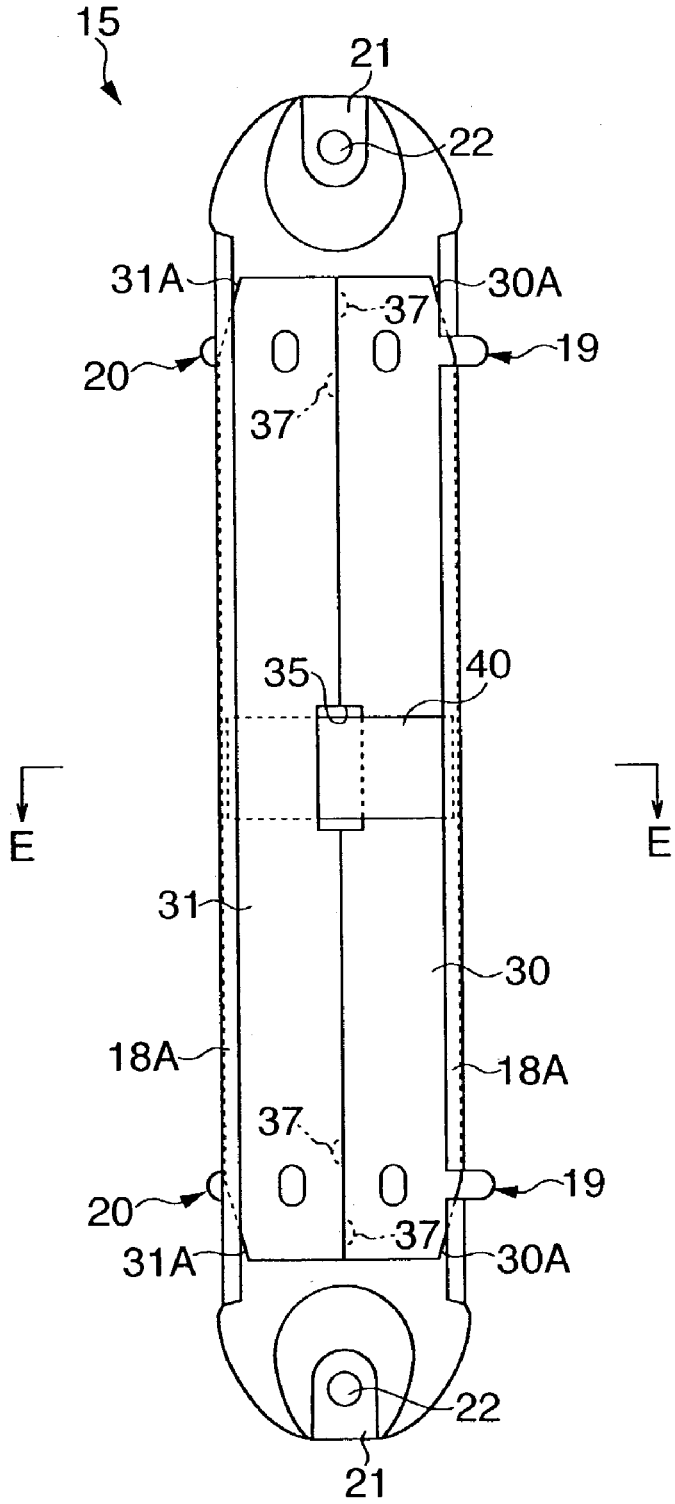
FIG. 13 is a bottom view illustrating a binder according to a second embodiment.
Figure 14:
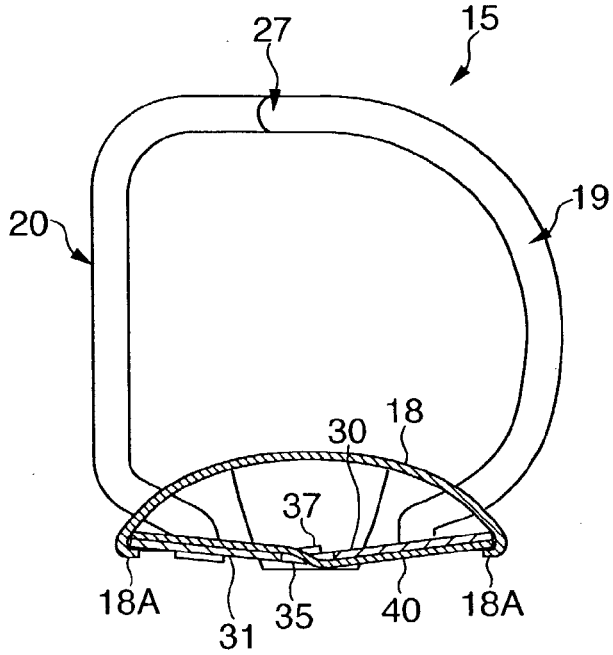
FIG. 14 is an enlarged sectional view taken along an arrow line E—E of FIG. 13.
Figure 15:
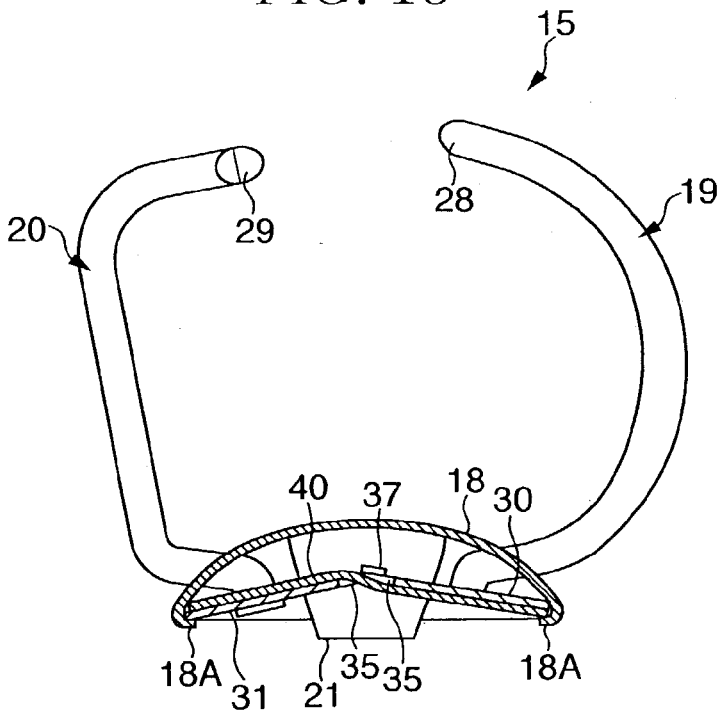
FIG. 15 is a sectional view of a binding member that is opened from the state shown in FIG. 14.

Next, referring to FIGS. 13–15, embodiments of the invention other than the first embodiment will be described. In the following descriptions, the component parts, which are the same or equivalent to those of the first embodiment, will be given with the same symbols, and the description will be omitted or simplified.

[Second Embodiment]

A second embodiment is characterized in that a leaf spring 40 is adopted as a releasing means in place of the coil spring 33. That is, the leaf spring 40 comprises a generally rectangular metal plate extending in the smaller width direction of the base 18. The leaf spring 40 is disposed being inserted through the notch 35 formed between the contact edge portion between the first and second connecting plates 30, 31 and extends to the outside and the inside thereof. A half of the leaf spring 40 is positioned at the bottom side of the first connecting plate 30; while the other half is positioned at the topside of the second connecting plate 31. The leaf spring 40 is such adapted that the initial configuration thereof is a bent shape as shown in FIG. 15, and when the first and second binding members 19, 20 are made into the closed state, the bending direction is slightly inverted as shown in FIG. 14. Accordingly, the leaf spring 40 maintains a state that a force is given in the direction that the first and second binding members 19, 20 are opened. Like the first embodiment, when an operating force that makes the first binding members 19, 19 closer to each other is given, the closed state is immediately released.

Accordingly, owing to the arrangement of the second embodiment, it makes possible to obtain the same action and effect as the first embodiment and, further, the assembly thereof can be carried out easier than the first embodiment.

Figure 16:
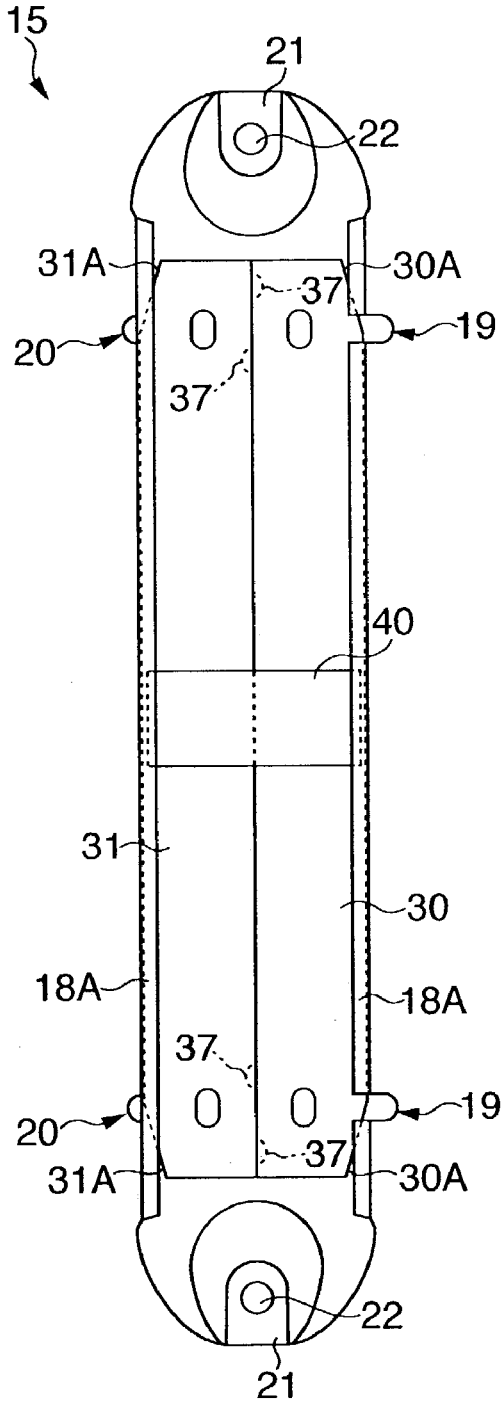
FIG. 16 is a bottom view of the binder illustrating an example of modification of the second embodiment.
Figure 17:
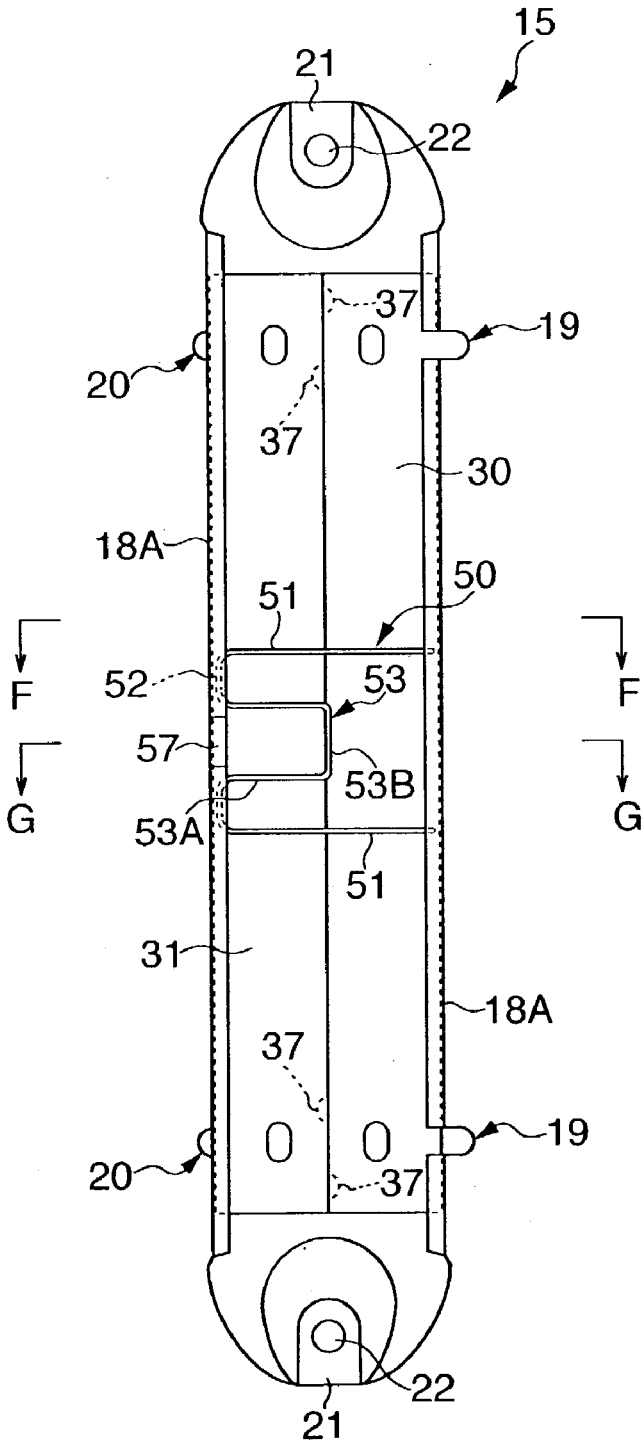
FIG. 17 is a bottom view illustrating a binder according to a third embodiment.

In the second embodiment, although a case in which the leaf spring 40 is disposed to go through the notch 35 is given, the entire leaf spring 40 may be positioned at the outside of the first and second connecting plates 30, 31 as shown in FIG. 16. In this case, the formation of the notch 35 between the first and second connecting plates 30, 31 is unnecessary.

[Third Embodiment]

Figure 18:
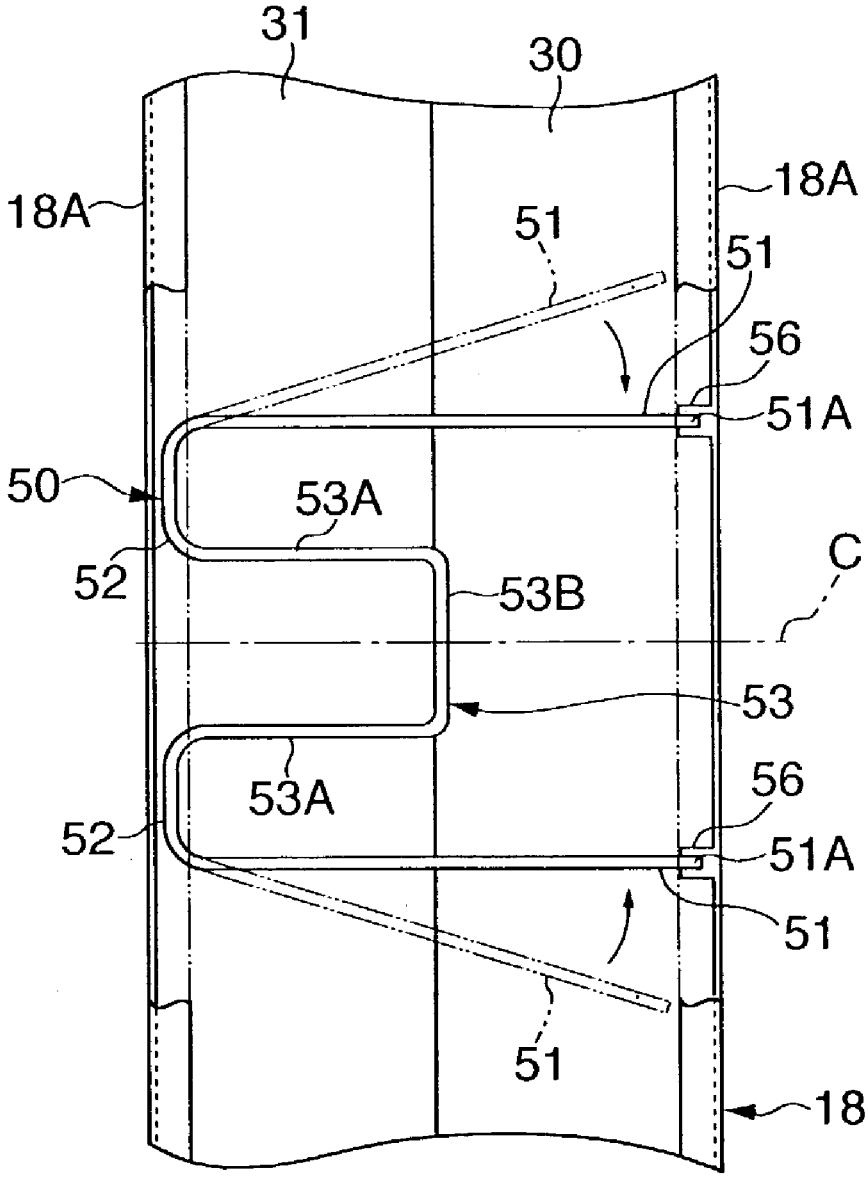
FIG. 18 is an enlarged view of the principal parts being partially cut off from the binder shown in FIG. 17.
Figure 19:
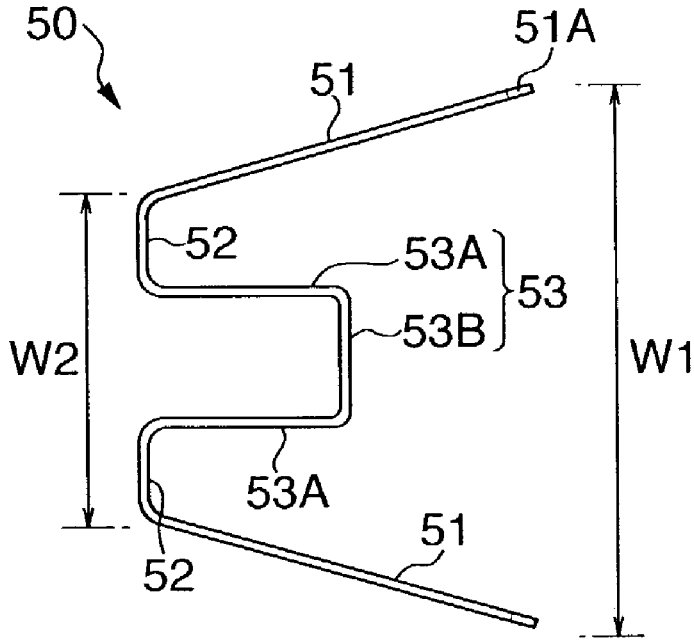
FIG. 19(A) is a plan view of a wire member.
FIG. 19(B) is a front view of the wire member.
Figure 19:
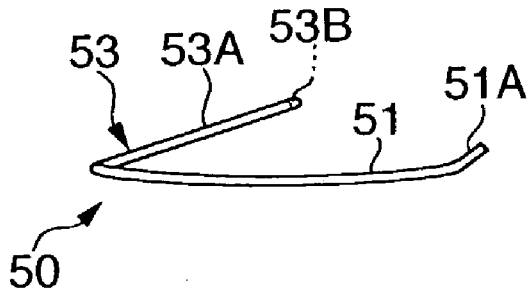
Figure 20:
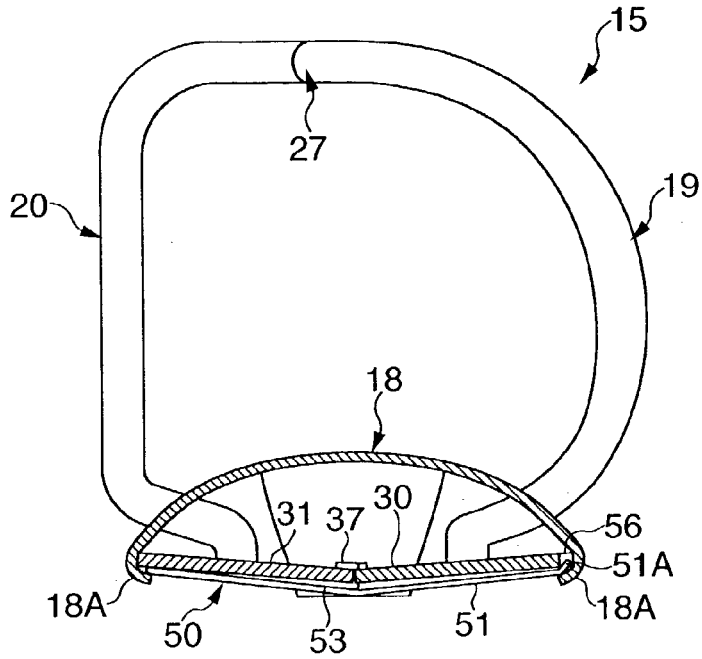
FIG. 20 is an enlarged sectional view taken along an arrow line F—F of FIG. 17.
Figure 21:
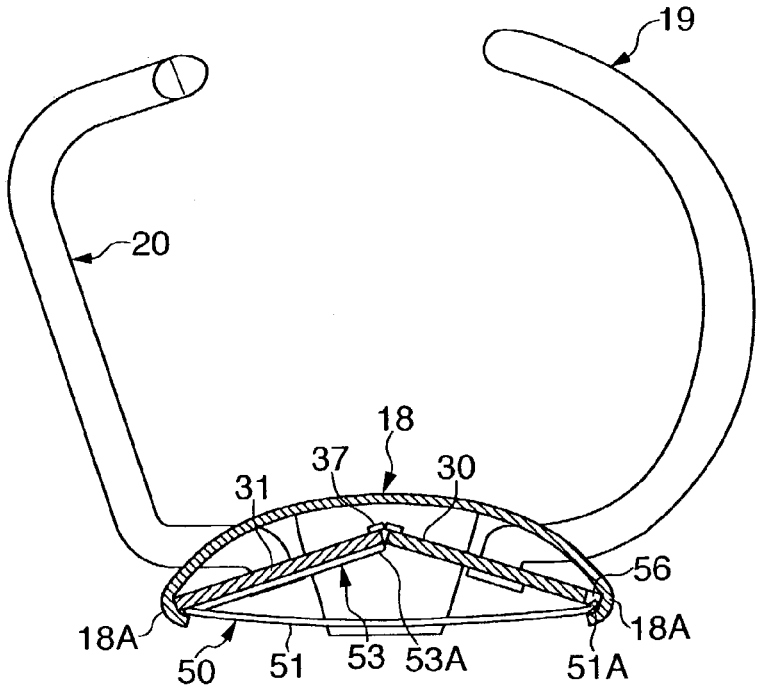
FIG. 21 is a sectional view illustrating the binding member that is opened from the state shown in FIG. 20.
Figure 22:
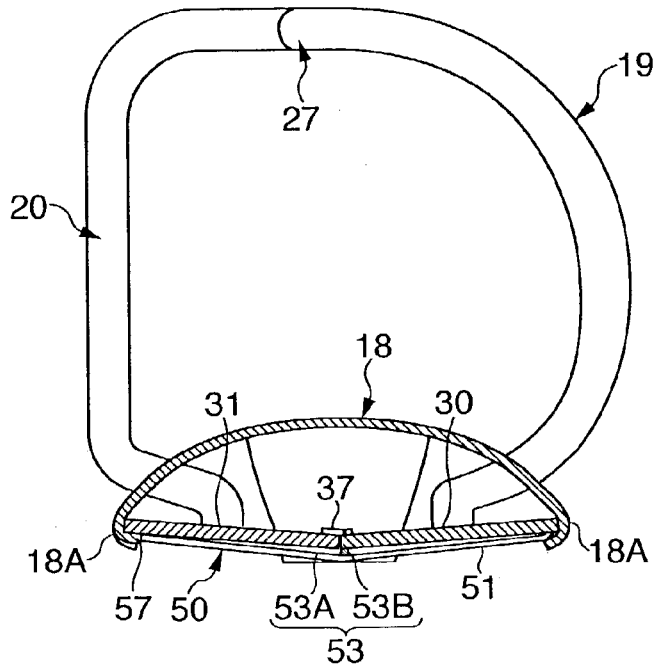
FIG. 22 is an enlarged sectional view taken along an arrow line G—G of FIG. 17.
Figure 23:
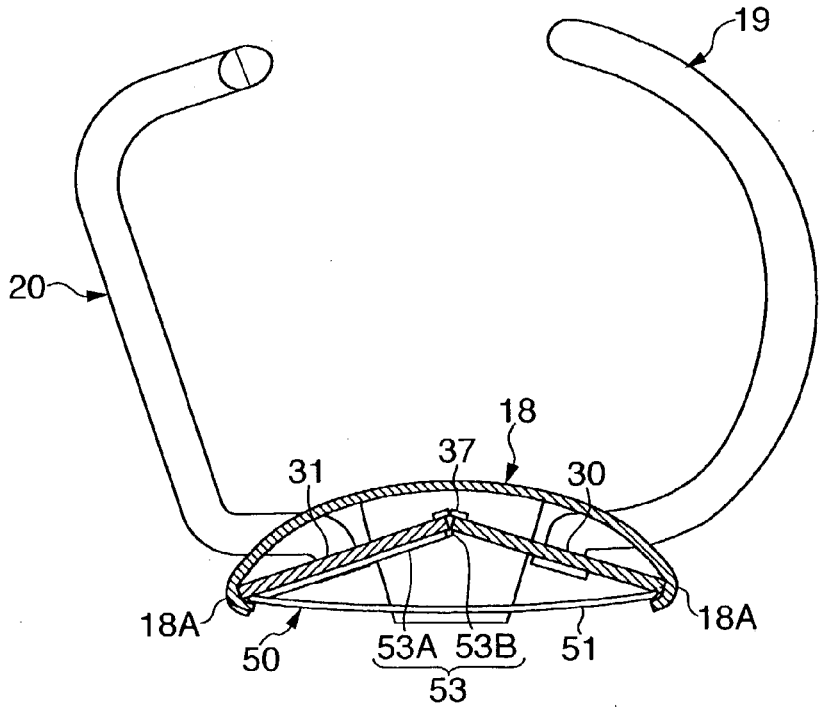
FIG. 23 is a sectional view of the binding member that is opened from the state shown in FIG. 22.

FIGS. 17–23 show a third embodiment of the invention. The third embodiment is characterized in that a wire member 50 is used as the releasing means. The wire member 50 is formed into a configuration or a size to be stored generally within the area of the first and second interconnecting plates 30, 31, and is disposed within the area of the first and second connecting plates 30, 31. Further detailed description of the wire member 50 will be made with reference to FIG. 18, FIGS. 19(A) and 19(B). The wire member 50 includes first portions of the wire member 51, 51 that are disposed to cross the first and second connecting plates 30, 31, and are positioned along the longitudinal direction of the base generally symmetrically with respect to the virtual central straight line along the width direction of the base 18; and of a second portion of the wire member 53 that is formed to be connected to one end side of these first portions of the wire member 51, 51, i.e., to the left side end in FIG. 18 being interposed by middle portions 52, 52, that is oriented toward the axis line which is shifted by a predetermined angle with respect to the axis line of the first portion of the wire member 51, and that is positioned generally symmetrically with respect to the central straight line C. Here, the second portion of the wire member 53 comprises inner portions of the wire member 53A, 53A extending parallel to each other, and a connecting portion of the wire member 53B that connects these inner portions of the wire member 53A, 53A. As shown in FIG. 18, the shaft length of the inner portions of the wire member 53A, 53A is adapted to generally a half or so of the first portion of the wire member 51 so that the connecting portion of the wire member 53B is positioned adjacent to the contact edge portion between the first and second connecting plates 30, 31. In the present embodiment, the inner portions of the wire member 53A, 53A are adapted to a length that, when the same is disposed to cross the second connecting plate 31 in the width direction, the connecting portion of the wire member 53B reaches a little to the area of the first connecting plate 30.

In the first portions of the wire member 51, 51, the ends opposite to the middle portions 52, 52 are bent portions 51A, 51A, and these bent portions 51A, 51A are received within the notches 56, 56 formed in the outer edge of the first connecting plate 30. On the other hand, the middle portions 52, 52 are adapted so as to be, in the respective spaces, strongly tightened or enclosed by a step-pressed portion 57 formed in a part of the caulking portion 18A. Here, an anti-drop-off mechanism of the wire member 50 is constituted of the bent portions 51A, the notches 56 and the step-pressed portion 57.

As for the wire member 50, a wire member having such a configuration as the initial configuration before being mounted that the width W1 between the bent portions 51A, 51A of the first portions of the wire member 51, 51 is wider than the width W2 at the middle portions 52, 52 side is used. To mount the wire member 50, in a state that the step-pressed portion 57 has been formed before hand, when the middle portions 52, 52 of the wire member 50 are pressed to engage into the caulking portion 18A until a sound "click" is emitted, the first portions of the wire member 51, 51 are positioned respectively at the positions indicated with the chain double-dashed lines in FIG. 18. Then, by carrying out a work in such a manner that the first portions of the wire member 51, 51 are nipped with fingertips and shifted to become generally parallel to each other, it is made possible to assembled the bent portions 51A, 51A being received by the notches 56.

In the third embodiment, in a state that the wire member 50 is mounted within the area of the first and second connecting plates 30, 31 and the first and second binding members 19, 20 are closed, as shown in FIGS. 20-23, the second portion of the wire member 53 becomes into a state being pressed down forcibly to be positioned on a plane generally even with respect to the first wire member. At the same time, a state that the inner sides in the width direction of the first and second connecting plates 30, 31 are positioned at a position slightly lower than the outer sides and propped up by each other is obtained. Here, when an operation is made in the direction that the first binding members 19, 19 are made to be closer to each other, the engagement with the second binding members 20 is released, and the second portion of the wire member 53 tends to rise up with respect to the first portion of the wire member 51 to return to the original configuration. Accordingly, owing to the restoring force, the inner sides of the first and second connecting plates 30, 31 shift to a position higher than the outer sides thereof and bent into a generally L shape; and it makes possible to open the first and second binding members 19, 20.

Consequently, according to the third embodiment also the same effect as that of the embodiments aforementioned can be obtained and, in addition, such an effect that assembly work of the wire member 50 can be carried out much easily and swiftly is obtained.

Although the best arrangement, method and the like to carry out the invention have been disclosed in the above descriptions, the invention is not limited thereto.

That is to say, although the invention has been described about mainly specific embodiments while particularly illustrating them in the figures, it is possible for a person skilled in the art to add various modifications with respect to the configuration, material, quantity, position, layout or the like to the embodiments without departing from the scope of the technical ideas and object of the invention.

Accordingly, the defined descriptions about the disclosed configuration or the like are given illustratively only to make the invention be understood easily, but the descriptions do not limit the invention thereto. Therefore, any descriptions about components, of which name may partially or entirely depart from the definition of the configuration or the like, are all included in the invention.

Figure 24:
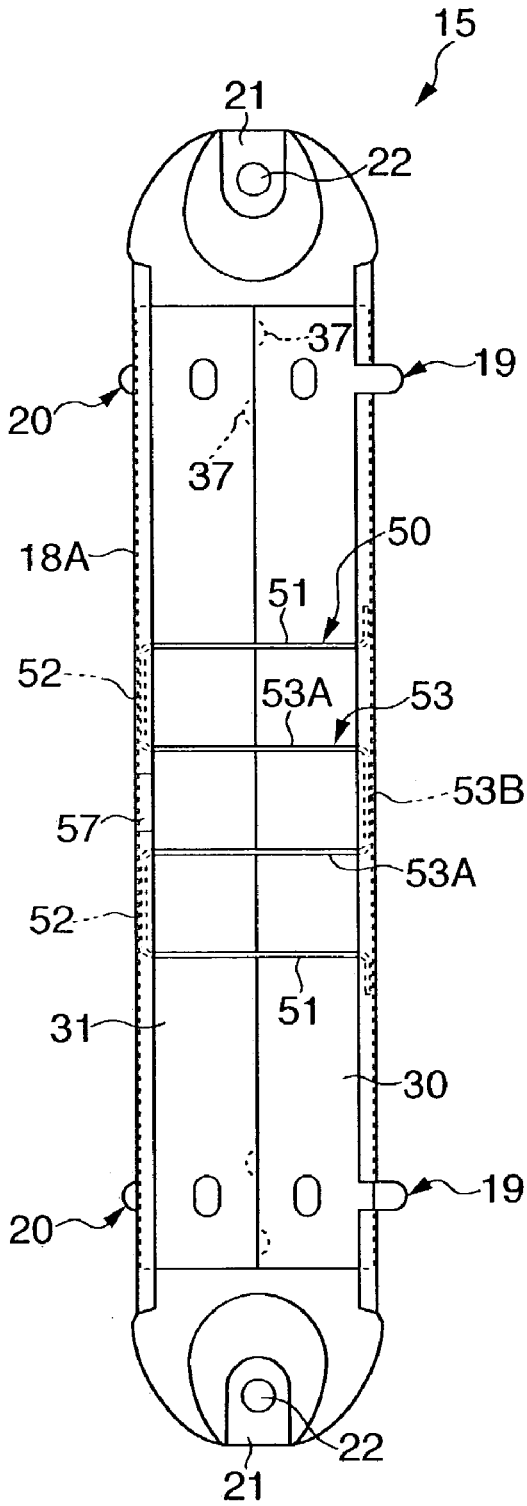
FIG. 24 is a bottom view illustrating an example of modification of the third embodiment.

For example, in the embodiment 3, a case, in which the inner portion of the wire member 53A in the second portion of the wire member 53 is shorter than the first portion of the wire member 51, is described. However, as shown in FIG. 24, the same may be adapted to be the same length or so as that of the first portion of the wire member 51. By adopting the structure also, when the engagement between the first and second binding members 19, 20 is disengaged, rotation in the direction to open them is made possible. Further, although the wire member 50 is located at the central area in the longitudinal direction of the base 18, for example, such a design change that, using two wire members 50, the same may be located separately at two positions along the longitudinal direction, and so on is possible. Furthermore, although the wire member 50 having a symmetrical configuration with respect to the centerline C is used, an symmetrical one may be used.

In the respective embodiments, although the cases, in which the first binding members 19, 19 are structured so that the closed state is released by giving the operation force in the direction that the same come closer to each other, have been illustrated and described, the invention is not limited thereto. For example, the second binding members 20, 20 may be such adapted that the closed state is released by parting the same away from each other. Also, such a structure, in which the closed state is released by giving the operating force in the direction that the second binding members 20, 20 are made to come closer to each other, or by parting the first binding members 19 away from each other, may be adopted. In that case, it is enough to form the hook configurations of the front ends of the first binding members 19 and the second binding members 20 in the reversed manner of the embodiments. Further, a couple of first binding member 19 and second binding member 20 forming a closed loop may be such structured that, for example, same as the case that a mutual engagement between two protruding portions provided on the rims of a purse is released, the closed loop is released by making a twist or twirl operation.

Further, in the embodiments, although such a structure is adopted that the engagement with the second binding members 20, 20 is disengaged by operating the first binding members 19, 19 in the direction that the same come closer to each other, the operation direction is not limited thereto. Such an arrangement that the disengagement is made by giving a force that operate the binding members in the direction that the same crosses the axial direction may be adopted.

In the invention, although the number of the first and second binding members 19, 20 is total four, which are coupled into the respective pairs, the number thereof may be further increased. Also, in case that the number of the binding members is increased, the front ends of the increased binding members at one side may be formed into such a shape that the same are brought into contact with the front ends of the binding members at the opposite side. Owing to this, it is made possible to open the binding members without increasing the number of binding members to be operated by fingertips when disengaging the engagement.

In the third embodiment, a case, in which the releasing means for giving the force in the direction that the closed loop is released is disposed at a generally symmetrical position with respect to the virtual centerline C, has been illustrated and described. The invention is not limited thereto, but such cases, in which the releasing means is disposed within the area along the longitudinal direction of the base 18, or a plurality of releasing means different from each other, for example, the coil spring 33 and the wire member 50 are used simultaneously, are included in the conception of the invention.

As described above, according to the invention, the engagement is released only by giving an operating force to the first binding members or the second binding members, and the binding members are made to rotate in the direction that the same are opened by the releasing force of the releasing means. And when operating to make the binding members into the closed state, since it is such arrangement that the operation is made in the direction opposite to the direction of the force via the releasing means, a noise is not emitted when the binding members shift into the closed state to form closed loops. And further, since the operation force is given in the direction opposite to the direction that the spring force acts, it makes possible to regulate the speed of the first and second binding members when the same are closed, and a fear rendered by the conventional binder, which closes instantly, can be also eliminated.

Also, since it is adapted so that the coil spring comprising the releasing means is supported by the notch not to drop-off, assembly of the coil spring can be carried out easily, and since the spring is maintained at a specific position, it is possible to prevent operation failure from occurring.

Since also the leaf spring constituting the releasing means extends between the first and second connecting members and is supported not to drop-off, it is possible to maintain the leaf spring at a specific position and to effectively prevent operation failure from occurring in the same manner as the coil spring.

The wire member constituting the releasing means comprises the first portion of the wire member disposed crossing the first and second connecting member, and the second portion of the wire member, which has been shifted by a predetermined angle with respect to the first portion of the wire member. Therefore, it is possible to apply the releasing means to obtain a spring force only by adjusting the axial orientation of the wire member and, since the wire member can be assembled easily, it is possible to lead to a better productivity also.

Further, since the wire member is disposed to be generally symmetrical with respect to the virtual straight line, in the structure that the wire member is used as the open/close means, the force in the direction that the first and second binding members are opened is generated being preferably dispersed. Accordingly, it is possible to prevent the open failure from occurring.

Furthermore, since the wire member is supported by the base via an anti-drop-off mechanism, there is no possibility that the wire member is shifted unintentionally. Accordingly, it is possible to allow the spring force to act in a stable state.

Since it is such arrangement that the first and second connecting members are, or the first binding members or the second binding members are bent and deformed, and thereby the engagement between the first and second binding members is disengaged, it is possible to reduce the operation force for releasing the binding members. Particularly, in the structure that the connecting members are bent and deformed, it is possible that the binding member is arranged of a material having rigidity, resulting in providing a binder excellent in durability.

Owing to the structure that the inclined edges are formed on the outer edges of the end portions along the longitudinal direction of the first and second connecting plates constituting the first and second connecting members, it is possible to make the end areas in the longitudinal direction of the respective connecting plates be bent easily, making it possible to reduce the force for disengaging the engagement between the first and second binding members.

What is claimed is:

1. A binder, comprising:

first binding members;

second binding members moveable relative to and respectively engageable with said first binding members to form closed loops in a closed state of said binder;

a first connecting member connecting said first binding members to each other and a second connecting member connecting said second binding members to each other, said first and second connecting members being moveable relative to each other; and a spring biasing the binding members away from the closed state and into an open state of said binder in which open state said loops are opened;

wherein said first binding members are disengaged from the second binding members when said first binding members are moved toward each other or when said second binding members are moved away from each other, thereby allowing said disengaged binding members to subsequently move into the open state under action of said spring;

said first and second connecting members have respective inner and outer sides, the inner sides of the connecting members are adjacent to each other and positioned lower than the outer sides thereof when said first and second binding members are engaged;

the inner sides of the connecting members are shifted to a position higher than the outer sides thereof by said spring so that the loops formed by the first and second binding members are opened when the engagement between said first and second binding members is released;

said connecting members are slanted relative to each other and define a V shape when said first binding members are engaged with the respective second binding members in the closed state of said binder; and said spring comprises a wire member that is located below said first and second connecting members and has a generally M- or W- shaped configuration defined by a first end section extending transversely of said binder from the outer side of said first connecting member to the outer side of said second connecting member;

a first middle section contiguous to the first end section and extending transversely of said binder from the outer side of said second connecting member toward said first connecting member;

a second middle section contiguous to the first middle section and extending transversely of said binder in a direction opposite to the first middle section back to the outer side of second connecting member; and a second end section contiguous to the second middle section and extending transversely of said binder from the outer side of said second connecting member to the outer side of said first connecting member;

wherein said first and second end sections define a first portion and said first and second middle sections define a second portion which is biased by an elasticity of said wire member to swing upwardly from said first portion to bring the binder to the open state when said first binding members are disengaged from the second binding members.

2. The binder according to claim 1, wherein at least one of said first and second connecting members is bent and deformed when the engagement between said first and second binding members is released by moving either said first binding members toward each other or said second binding members away from each other.

3. The binder according to claim 1, wherein said first and second connecting members are plates having longitudinal tapering ends.

4. The binder according to claim 1, wherein said first portion defines outer sides of said M- or W-shaped configuration and said second portion defines a middle of said M- or W- shaped configuration; and said first and second end sections and said first and second middle sections are all straight.

5. The binder according to claim 1, wherein said first portion underlies both said first and second connecting members and said second portion underlies only said second connecting member.

6. The binder according to claim 1, wherein both said first and second portions underlie both said first and second connecting members.

7. The binder according to claim 1, wherein said engagement between said first and second binding members prevents said first and second binding members from moving into the open state of said binder.

8. The binder according to claim 1, wherein an engagement force between said first and second binding members prevents said first and second binding members from moving into the open state of said binder and is greater than a biasing force of said spring.

9. The binder according to claim 1, wherein said binding members have engaging portions at which said binding members are engaged in the closed state of said binder, the engaging portions of said first binding members are oppositely configured.

10. The binder according to claim 1, wherein said binding members have engaging portions at which said binding members are engaged in the closed state of said binder, the engaging portions of said second binding members are oppositely configured.

11. The binder according to claim 1, wherein one of said first binding members is disengaged from the respective second binding member when moved relative to said respective second binding member in a first direction; and another one of said first binding members is disengaged from the respective second binding member when moved relative to said respective second binding member in a second direction opposite to the first direction.

12. The binder according to claim 1, wherein, in the closed state of said binder, said first binding members are movable toward each other without interfering with the respective second binding members so as to be disengaged from the respective second binding members.

13. A binder, comprising:

first binding members;

second binding members moveable relative to and respectively engageable with said first binding members to form closed loops in a closed state of said binder;

a first connecting member connecting said first binding members to each other and a second connecting member connecting said second binding members to each other, said first and second connecting members being moveable relative to each other; and a coil spring biasing the binding members away from the closed state and into an open state of said binder in which open state said loops are opened, said coil spring comprising a coil and two legs, each of said legs being located under one of said connecting members;

wherein said first and second connecting members have respective inner and outer sides;

the inner sides of the connecting members are adjacent to each other and positioned substantially coelevational with the outer sides thereof when said first and second binding members are engaged;

the inner sides of the connecting members have recesses facing each other, said recesses together defining a spring receiving space in which the coil of said spring is received;

one of said first binding members is disengaged from the respective second binding member when moved relative to said respective second binding member in a first direction;

another one of said first binding members is disengaged from the respective second binding member when moved relative to said respective second binding member in a second direction opposite to the first direction;

at least one of the inner sides of said connecting members further comprises two projections projecting into said spring receiving space; and the coil of said spring has opposite hollow ends fitted over said projections which hold said coil in said spring receiving space.

14. The binder according to claim 13, wherein said first direction is a longitudinal direction of said binder oriented from said one of said first binding members toward said another one of said first binding members.

15. The binder according to claim 13, wherein said engagement between said first and second binding members prevents said first and second binding members from moving into an open state of said binder in which open state the loops are opened.

16. The binder according to claim 13, wherein said binding members have engaging portions at which said binding members are engaged in the closed state of said binder, the engaging portions of said first binding members are oppositely configured.

17. The binder according to claim 13, wherein, in the closed state of said binder, said first binding members are movable toward or away from each other without interfering with the respective second binding members so as to be disengaged from the respective second binding members.

18. The binder according to claim 13, wherein said legs extend from said coil in opposite directions towards the outer sides of said first and second connecting members, respectively.

19. The binder according to claim 13, wherein the inner sides of the connecting members are adjacent to each other and define a center line of said binder when said first and second binding members are engaged; and said spring receiving space and the coil of said coil spring are disposed on said center line.

20. A binder, comprising:

first binding members;

second binding members moveable relative to and respectively engageable with said first binding members to form closed loops in a closed state of said binder;

a first connecting member connecting said first binding members to each other and a second connecting member connecting said second binding members to each other, said first and second connecting members being moveable relative to each other; and a spring biasing the binding members away from the closed state and into an open state of said binder in which open state said loops are opened;

wherein said first binding members are disengaged from the second binding members when said first binding members are moved toward each other or when said second binding members are moved away from each other, thereby allowing said disengaged binding members to subsequently move into the open state under action of said spring;

said first and second connecting members have respective inner and outer sides, the inner sides of the connecting members are adjacent to each other;

the inner sides of the connecting members are shifted to a position higher than the outer sides thereof by said spring so that the loops formed by the first and second binding members are opened when the engagement between said first and second binding members is released; and said spring comprises a wire member that is located below said first and second connecting members and has a generally M- or W- shaped configuration defined by a first end section extending transversely of said binder from the outer side of said first connecting member to the outer side of said second connecting member;

a first middle section contiguous to the first end section and extending transversely of said binder from the outer side of said second connecting member toward said first connecting member;

a second middle section contiguous to the first middle section and extending transversely of said binder in a direction opposite to the first middle section back to the outer side of second connecting member; and a second end section contiguous to the second middle section and extending transversely of said binder from the outer side of said second connecting member to the outer side of said first connecting member;

wherein said first and second end sections define a first portion and said first and second middle sections define a second portion which is biased by an elasticity of said wire member to swing upwardly from said first portion to bring the binder to the open state when said first binding members are disengaged from the second binding members.

* * * * *